US005421994A

United States Patent [19]

Sarrazin et al.

[11] Patent Number: 5,421,994

[45] Date of Patent: Jun. 6, 1995

[54] PROCESS FOR THE RECOVERY OF MERCURY AND ARSENIC IN A HYDROCARBON CUT

[75] Inventors: Patrick Sarrazin, Rueil Malmaison; Charles Cameron, Paris; Jean-Paul Boitiaux, Poissy; Philippe Courty, Houilles; Yves Barthel, Paris, all of France

[73] Assignee: Institut Francais Du Petrole, Rueil-Malmaison, France

[21] Appl. No.: 59,396

[22] Filed: May 11, 1993

[30] Foreign Application Priority Data

May 11, 1992 [FR] France ..... 92 05770

[51] Int. Cl.[6] ..... C10G 17/00

[52] U.S. Cl. ..... 208/251 R; 423/210; 585/822; 585/823; 585/843; 585/845; 585/850

[58] Field of Search ..... 208/251 R, 187, 299, 208/301, 302; 423/210; 585/822, 823, 843, 845, 850

[56] References Cited

U.S. PATENT DOCUMENTS

| | | | |
|---|---|---|---|
| 3,804,750 | 4/1971 | Myers et al. | 208/89 |
| 4,069,041 | 1/1978 | Görling et al. | 75/101 |
| 4,911,825 | 3/1990 | Roussel et al. | 208/251 R |
| 5,062,948 | 11/1991 | Kawazoe et al. | 208/251 R |

FOREIGN PATENT DOCUMENTS

| | | | |
|---|---|---|---|
| 0385742 | 9/1990 | European Pat. Off. | C10G 25/00 |
| 0412862 | 2/1991 | European Pat. Off. | C10G 25/00 |
| WO90/10684 | 9/1990 | WIPO | C10G 67/06 |

*Primary Examiner*—Helane Myers

*Attorney, Agent, or Firm*—Millen, White, Zelano, & Branigan

[57] ABSTRACT

A process for the recovery of mercury and arsenic for which elementary mercury and/or mercury mercaptides are recovered prior to the recovery of arsenic and wherein the recovery temperature of the arsenic is higher than the recovery temperature of the mercury.

22 Claims, No Drawings

PROCESS FOR THE RECOVERY OF MERCURY AND ARSENIC IN A HYDROCARBON CUT

BACKGROUND OF THE INVENTION

The present invention relates to a process for the recovery of mercury and arsenic contained in a hydrocarbon charge, the majority of the mercury being in elementary form and/or in the form of mercaptides. The process is characterised in that the charge is placed in contact with at least one recovery mass M1 for the mercury at a temperature T1 of less than 175° C. and that the product obtained is placed in contact with a recovery mass (M2) for arsenic in the presence of hydrogen at a temperature T2 which is greater than, or equal to, T1 and which is above 130° C.

Mercury and arsenic are pollutants which are often present in hydrocarbon cuts such as liquified petroleum gases, and condensates associated with natural gas or naphthas. Valorisation of these hydrocarbons in various refining and petrochemical processes is impeded because the installations and catalysts become contaminated. Steam-cracking can be cited as an example, where the treatment of hydrocarbons polluted by mercury and arsenic can cause both corrosion of the aluminium alloy based exchangers in the cryogenic section used for separations, and poisoning of the selective hydrogenation catalysts of the olefinic cuts produced.

In the domain of the refining of crude petroleum, similar contamination problems, such as contamination by arsenic, can be encountered, which leads to poisoning of the hydrotreatment catalysts.

Prior art known for the removal of mercury or arsenic from hydrocarbons includes assignee's process described in U.S. Pat. No. 4,911,825, allowing mercury and arsenic contained in a hydrocarbon to be recovered. This process comprises treatment in two successive steps of different kinds of masses, also under different operating conditions.

The recovery mass for arsenic used in the first step is constituted of at least one metal M selected from the group formed by iron, nickel, cobalt, palladium, used as such, or preferably deposited on the support. 50% of the metal M as a whole must be in reduced form. It is preferable to use nickel or to associate nickel with palladium.

The Applicant has also described the use of other masses for the recovery of arsenic during this first step in the patents EP A 412 862 and WO A 90/10684.

The recovery mass for mercury used in the second step contains sulphur and a metal sulphide. The prior art process for recovery of mercury and arsenic, described in the assignee's U.S. Pat. No. 4,911,825, is carried out in the following way:

1) the hydrogen is mixed with the charge to be purified,
2) the mixture is heated to the required temperature for the first reactor, thus to a temperature of between 130° and 250° C. for the masses described in the patent U.S. Pat. No. 4,911,825 and between 180° and 450° C. for the masses described in the patent WO A 90/10684.
3) The mixture is placed in contact with the mass for recovery of arsenic in the first reactor where all the arsenic compounds are converted into arsine, ($ASH_3$) and all the mercury compounds are converted into elementary mercury. The arsenic is retained by this recovery mass, but the mercury is not retained.

4) The effluent From this First reactor, from which effluent arsenic has been removed, is cooled to the required temperature for the second step, to between 0° and 175° C.
5) The cooled mixture enters the second reactor where the mercury is retained by a recovery mass for the mercury.

The prior art, described hereinabove, is very effective for the recovery of arsenic and mercury which are present in various chemical forms in hydrocarbon charges. The First step permits conversion of the organomercuric species, $HgR_2$ where R is an organic radical in the presence of hydrogen into elementary mercury and 2HR. In Fact, the conversion of organomercurics into elementary mercury is obligatory for the recovery of mercury.

Nonetheless, this prior art is ill suited to hydrocarbon charges of very low mercury content in the form of organomercuric contents. Two fundamental problems with the prior art are:

1) the need to mix the hydrogen with the charge prior to recovery of the mercury, and
2) having to cool the hydrocarbon charge between the two steps of the process.

SUMMARY OF THE INVENTION

It has been discovered that the mercury in elementary form and the mercaptides can surprisingly be recovered in the absence of hydrogen. The new process according to the present invention allows recovery masses to be used for mercury in the absence of hydrogen, arsenic to be recovered and a significant reduction to be achieved in investment costs in comparison with the prior art process.

The present invention is a process for the recovery of mercury and arsenic contained in a hydrocarbon charge, the mercury being in elementary form and/or in the form of mercaptides, characterised in that the charge is placed in contact with at least one recovery mass (M1) for mercury at a temperature (T1) which is less than 175° C., and in that the product obtained is placed in contact with a recovery mass (M2) for arsenic in the presence of hydrogen, at a temperature (T2) which is greater than, or equal to, T1 and above 130° C.

The hydrocarbons to be treated can be in gaseous phase or in liquid phase. Usually, it is preferable to operate in gaseous phase for hydrocarbons where the number of carbon atoms is less than 5. For liquid hydrocarbon cuts of normal temperature and pressure, the process is carried out in liquid phase, but it is possible to operate in mixed phase.

The recovery masses (M1) for the mercury which are used in the present invention can be identical to, or different From, the recovery masses (M2) for arsenic. When the masses M1 are different from the masses M2, they contain sulphur, metal sulphide, zinc or tin.

The recovery mass (M1) can be constituted of sulphur or a sulphur compound deposited on a mineral solid support or disperser, which may be selected from the group formed by alumina, silica-aluminas, silica, zeolites, clays, active carbons, aluminous cements.

The recovery mass used can be sulphur deposited on a support. It is also possible to use a compound containing sulphur and a P metal where P is selected from the group formed by copper, iron, silver, and, preferably, by copper or the association of copper-silver. At least 50% of the metal P is used in sulphide form.

The use of tin in the composition of the recovery mass (M1) is preferable in the form of $SnCl_2$ deposited on a mineral solid support or disperser, selected, for example, from the group formed by alumina, silica-aluminas, silica, zeolites, clays, active carbons and aluminous cements. One example which can be cited is $SnCl_2$ on carbon prepared according to the method stated in the patents U.S. Pat. No. 5,062,948 and EP A 433 677.

In cases where the hydrocarbon charge to be treated contains significant quantities of mercaptans, it has been discovered that it is advantageous to place the charge in contact with a mass containing at least 25% by weight of zinc.

The term, "significant quantities" means that the charge contains at least 50 ppm mercaptans, preferably at least 75 ppm mercaptans and advantageously at least 100 ppm mercaptans.

The masses containing at least 25% by weight of zinc, preferably 35% by weight of zinc, can contain zinc in the form of metallic zinc, zinc oxide and/or a zinc compound capable of decomposing thermally into zinc oxide, such as zinc carbonate or zinc hydroxycarbonate. In cases where the hydrocarbon charge to be treated contains significant quantities of mercaptans, the zinc is advantageously in the form of zinc oxide and/or zinc carbonate and/or zinc hydroxycarbonate, and very advantageously in the form of zinc hydroxycarbonate.

The recovery masses (M2) for the arsenic which can be used in the present invention are those described in the assignee's U.S. Pat. No. 4,911,825 and WO A 90/10684.

There are two types:

1) recovery masses (M2) for arsenic containing at least one metal from the group formed by iron, cobalt, nickel and palladium used preferably deposited on a support and in reduced form, at least for 50% of its whole, and
2) recovery masses (M2) for arsenic containing at least one metal selected from the group formed by nickel, cobalt, iron, palladium and platinum, and at least one metal selected from the group formed by chromium, molybdenum, tungsten and uranium, deposited on a support.

The supports used for the recovery masses are selected from the group formed by alumina, silica-aluminas, silica, zeolites, active carbon, clays and aluminous cements.

The support can be constituted advantageously of an alumina with or without an aluminate. It preferably has a large surface area and an adequate porous volume, that is to say at least 50 $m^2/g$ and at least 0.5 $cm^3/g$, for example 50 to 350 $m^2/g$ and 0.5 to 1.2 $cm^3/g$ respectively.

When an aluminate is present in the recovery mass M2, it is preferably selected from those of at least one metal of the group: Mg, Ca, St, Ba, Mn, Fe, Co, Ni, Cu and Zn, as described in the assignee's patent EP A 412 862.

One such mass M2 comprises 60 to 97% by weight of a porous support containing by weight from 40 to 98.5% alumina; from 1.5 to 60% oxide of at least one metal A combined with alumina in the form of aluminate and selected from the group formed by Mg, Ca, St, Be, Mn, Fe, Co, Ni, Cu and Zn; said mass also comprising from 3 to 40% by weight of nickel oxide impregnated by exchange or deposit on the support.

The mass M2 can also be selected from the group constituted by nickel and molybdenum sulphides, nickel and tungsten sulphides and cobalt and molybdenum sulphides.

The operating temperature T1 of the present invention is less than 175° C. If M1 contains nickel in the metallic state, the temperature T1 is between 0° and 130° C.

The operating temperature T2 in the present invention can vary from 130° to 450° C., more advantageously from 180° to 390° C.

When the charge contains significant quantities of mercaptans, a recovery mass (M1) with zinc base can advantageously be used. This mass with a zinc base can either replace another recovery mass (M1) for mercury, or it can be intercalated between another recovery mass (M1) and the recovery mass (M2), or it can be used in front of another recovery mass (M1) for mercury. The mass with zinc base is preferably disposed in front of, or in the place of, another recovery mass (M1).

The operating pressure of the present invention can be different or the same in the two reactors. Preferably, the two reactors operate at the same pressure. The operating pressures are selected from 1 to 90 bars, preferably from 2 to 45 bars, and more particularly from 5 to 35 bars. The spatial speed calculated for each of the recovery masses can be from 1 to 50 $h^{-1}$, and more particularly from 1 to 30 $h^{-1}$ (volumes-liquid-per volume of recovery mass, and per hour).

The hydrogen flow rate in relation to the recovery mass (M2) is, for example, between 1 and 500 volumes (gas under normal conditions) per volume of mass M2 and per hour.

EXAMPLES

The tests for recovery of mercury and arsenic according to the present invention have been carried out with two in series reactors: the first reactor (R1) containing the mass (M1) operates at a temperature (T1) and the second reactor (R2) containing the mass (M2) operates at a temperature (T2). All the purification tests were carried out at a pressure of 25 bars, except in the case of reactor R2 in Example 7. The two stainless steel reactors of internal diameter 3 cm were filled with 50 $cm^3$ of a recovery mass. In all the examples given hereinafter, the quantities of mercury and arsenic have been measured in the charge. After 250 h of operation, the quantities of mercury and arsenic were determined in the effluents of the reactor R1 and of the reactor R2.

Example 1

The mass M1 used in this example is composed of copper sulphide on a support of alumina balls, and it has been prepared in the way described in the assignee's U.S. Pat. No. 4,094,777.

The product used as mass M2 is a nickel compound in the metallic state on a support of alumina balls. The mass has been prepared and reduced in accordance with the procedure described in Example 1 of the assignee's U.S. Pat. No. 4,911,825.

For this test, 300 l naphtha (final boiling point 180° C.) without any detectable quantities of mercury, arsenic and mercaptans was used to prepare the charge. Thirty liters of this naphtha was then placed in contact with 300 g metallic mercury, and the mixture was agitated in a closed metal container for 72 h at ambient temperature. The 30 l naphtha was separated from the non-solubilised mercury by decantation, and then mixed with the 270 l naphtha without any mercury. The concentration of metallic mercury in this charge was 2260 ppb.

The test was carried out at a volumetric speed per hour (VVH) of the liquid of 8 $h^{-1}$, and at a volumetric speed per hour of the gas (VVHG) of 44 $h^{-1}$. The temperatures T1 and T2 are 22° and 170° C. respectively. The hydrogen was mixed with the charge after reactor R1. After 250 h, the concentrations of mercury at the exit from the reactors R1 and R2 were 45 and 45 ppb respectively, showing a 98% success rate of the demercurisation operation.

Example 2

Example 2 was carried out under the same conditions as those described in Example 1, except that the mass M2 was absent (and the flow rate of hydrogen stopped). Moreover, pastilles of zinc oxide (thickness=5 mm, diameter=11 mm), marketed by the company Grande Paroisse, were cut into four and used in a reactor R1 in front of the reactor R1 containing the mass M1. The reactors R1 and R1' operate under the same operating conditions and contain the same volume of catalyst.

After 250 h of testing, the concentrations of mercury after the reactors R1' and R1 were 2253 and 41 ppb respectively. The efficiency of the operation for recovering mercury was 98.2%.

Example 3

The mass composed of nickel in metallic state, described hereinabove in Example 1, was used as the masses M1 and M2. The respective temperatures T1 and T2 were set at 22° and 170° C. The conditions and the charge described in Example 1 are identical for this test. The quantities of mercury found after 250 h of testing were 294 ppb after R1 and 288 ppb after R2. The efficiency of the mercury recovery operation was 87.2%.

Example 4

A naphtha without mercury and containing 240 ppm mercaptans and 66 ppb arsenic was used for preparation of the charge. Twelve liters of this naphtha was mixed with 160 g metallic mercury and the mixture was agitated for 72 h at ambient temperature. The naphtha was then separated from the excess mercury, and then mixed with 388 l mercury-free naphtha to obtain 400 l of a charge with a mercury concentration of 2440 ppb. This charge was used in Examples 4 to7.

The masses M1 and M2 and also the operating conditions used in this test were identical to those stated in Example 1. After 250 h of testing, the concentrations of mercury and of arsenic at the exit from the reactors R1 and R2 were as Follows: R1: 40 ppb (Hg), 62 ppb (As); R2: 35 ppb (Hg), 36 ppb (As). The efficiencies of the operations for recovery of mercury and arsenic were 98.6 and 45.5% respectively.

Example 5

The zinc oxide (M1) and the mass composed of metallic nickel (M2) were used at 20° (T1) and 210° C. (T2). The charge described in Example 4 was used. All the other conditions for the test were identical to those in Example 1. The results after 250 hours of operation were: R1: 928 ppb (Hg), 64 ppb (As), R2 920 ppb (Hg), 12 ppb (As), 242 ppm (S). The efficiencies of the operations for recovering mercury and arsenic were 62.3 and 81.8% respectively.

Example 6

The charge containing 2440 ppb mercury, described in Example 4, was purified using the reactors R1 and R2, the mass being composed of nickel in the metallic state. The temperatures T1 and T2 were fixed at 22° and 210° C. respectively. After 250 h of testing, the concentrations found after the reactors R1 and R2 were: R1: 73 ppb (Hg), 62 ppb (As); R2: 47 ppb (Hg), <5 ppb (As). The efficiencies of the operations for recovery of mercury and arsenic were 97.3 and >92.4% respectively.

Example 7

This test for recovery of mercury and arsenic was carried out using the same charge as in the previous example. The mass M1 in the reactor R1 was identical to that containing copper sulphide described in Example 1.

The operating temperature for this mass was 22° C. for the entire duration of the test. Hydrogen (gaseous flow rate of hydrogen to VVH of 6) was added to the liquid effluent at ambient temperature at a total pressure of 50 bars, and then placed in contact with the mass M2 at a temperature T2 of 340° C. The mass M2 used in this example is the catalyst HMC 841 marketed by the company Procatalyse. This catalyst is formed of alumina balls containing nickel and molybdenum. Sulphur has been removed from the catalyst beforehand prior to charging in accordance with the Sulficat (R) process marketed by the company Eurecat. The results of the analysis obtained after 250 h at the exit from the reactors R1 and R2 were: R1: 39 ppb (Hg), 64 ppb )As); R2: 39 ppb (Hg), <5 ppb (As). The efficiencies of the operations for recovery of mercury and arsenic were 98.4 and >92.4% respectively.

Examples 8–10

Examples 8 to 11, described here, are given by way of comparison. Although it is possible to recover a limited quantity of mercury contained in the charge, the mercury content at the exit from reactor 2 is too great to permit good efficiency of the recovery operation.

Example 8

A condensate containing 2040 ppb mercury (only 240 ppb of which is in the form of metallic mercury), 56 ppb arsenic, and 123 ppb mercaptans was used as the charge in Examples 8 to 11. The masses M1 and M2 used in this example, and also the operating conditions, are identical to those stated for Example 1, except that the temperature T2 was fixed at 210° C. After 250 h of testing, the following results were obtained at the exit from the reactors R1 and R2 R1: 1811 ppb (Hg), 52 ppb (As); R2: 1808 ppb (Hg), 11 ppb (As). The purification rates of mercury and arsenic found were 11.4 and 80.4% respectively.

Example 9

The zinc oxide mass was used as the mass M1 at 20° C., with all the other conditions being kept the same as in the previous example. The results of the operation for recovery of the mercury and arsenic after 250 h were: R1: 1923 ppb (Hg), 54 ppb (As); R2: 1923 ppb (Hg), 7 ppb (As). The efficiencies of the recovery operations obtained were: 5.7% (Hg) and 87.5%, (As).

Example 10

This example was carried out by heating the zinc oxide mass (M1) to a temperature (T1) of 120° C. The other conditions of the test were identical to those described in Example 9. After 250 h of testing, the Following results were obtained: R1: 1891 (Hg), 49 ppb (As); R2: 1888 (Hg), 6 ppb (As). These results correspond to 7.5% and 90.9% efficiency for the operation for recovery of mercury and arsenic respectively.

Example 11

The operation for purification of the charge described in Example 8 was carried out using the masses M1 and M2, the temperatures T1 and T2 and the ratio of gaseous volumetric Flow per hour of hydrogen in relation to the liquid VVH (5,5) identical to those in Example 6. At the exit from the reactors R1 and R2, the Following concentrations of mercury and arsenic were obtained after 250 h: R1: 1798 ppb (Hg), 43 ppb (As); R2: 1787 ppb (Hg), <5 ppb (As). The efficiencies of the recovery operation were 13.9% (Hg) and 92.4% (As).

We claim:

1. A process for the recovery of mercury and arsenic contained in a hydrocarbon charge, the mercury being in elemental form and/or of mercaptides, wherein the charge is placed in contact with at least one recovery mass M1 for mercury at a temperature T1 which is less than 175° C., and the product obtained is placed in contact with a recovery mass M2 for arsenic, in the presence of hydrogen, and at a temperature T2 which is greater than T1 and greater than 130° C., the process being carried out at pressures of between 1 and 90 bars, wherein of all the mercury and arsenic recovered, most of the mercury is recovered in mass M1, and most of the arsenic is recovered in mass M2.

2. A process for the recovery of mercury and arsenic contained in a hydrocarbon charge, the mercury being in elemental form and/or of mercaptides, wherein charge is placed in contact with at least one recovery mass M1 for mercury at a temperature T1 which is less than 175° C., and the product obtained is placed in contact with a recovery mass M2 for arsenic, in the presence of hydrogen, and at a temperature T2 which is greater than or equal to T1 and greater than 130° C., the process being carried out at pressures of between 1 and 90 bars, wherein of all the mercury and arsenic recovered, most of the mercury is recovered in mass M1, and most of the arsenic is recovered in mass M2, and wherein the charge contains the mercaptides of mercury and/or mercaptans and said recovery mass M1 contains zinc oxide or a zinc oxide compound capable of thermal decomposition to zinc oxide.

3. A process according to claim 1, wherein the recovery mass M1 for the elemental mercury contains at least one compound selected from the group consisting of sulphur, metallic zinc, tin chloride, a copper sulphide, an iron sulphide, silver sulphide, and zinc sulphide.

4. A process according to one of claim 1, wherein the recovery mass M1 for the elemental mercury contains nickel in the metallic state and that the temperature at which the charge is placed in contact with said mass is between 0° and 130° C.

5. A process for the recovery of mercury and arsenic contained in a hydrocarbon charge, the mercury being in elemental form and/or of mercaptides, wherein the charge is placed in contact with at least one recovery mass M1 for mercury at a temperature T1 which is less than 175° C., and the product obtained is placed in contact with a recovery mass M2 for arsenic, in the presence of hydrogen, and at a temperature T2 which is greater than or equal to T1 and greater than 130° C., the process being carried out at pressures of between 1 and 90 bars, wherein of all the mercury and arsenic recovered, most of the mercury is recovered in mass M1, and most of the arsenic is recovered in mass M2, and wherein the recovery mass M2 for the arsenic contains 60 to 97% by weight of a porous support containing, by weight, from 40 to 98.5% alumina; from 1.5 to 60% oxide of at least one metal A combined with alumina in aluminate form, and selected from the group consisting of Mg, Ca, Sr, Be, Mn, Fe, Co, Ni, Cu and Zn; said mass also comprising 3 to 40% by weight of nickel oxide impregnated by exchange or deposit on the support.

6. A process for the recovery of mercury and arsenic contained in a hydrocarbon charge, the mercury being in elemental form and/or of mercaptides, wherein the charge is placed in contact with at least one recovery mass M1 for mercury at a temperature T1 which is less than 175° C., and the product obtained is placed in contact with a recovery mass M2 for arsenic, in the presence of hydrogen, and at a temperature T2 which is greater than or equal to T1 and greater than 130° C., the process being carried out at pressures of between 1 and 90 bars, wherein of all the mercury and arsenic recovered, most of the mercury is recovered in mass M1, and most of the arsenic is recovered in mass M2, and wherein the recovery mass M2 for arsenic contains nickel in metallic state.

7. A process for the recovery of mercury and arsenic contained in a hydrocarbon charge, the mercury being in elemental form and/or of mercaptides, wherein the charge is placed in contact with at least one recovery mass M1 for mercury at a temperature T1 which is less than 175° C., and the product obtained is placed in contact with a recovery mass M2 for arsenic, in the presence of hydrogen, and at a temperature T2 which is greater than or equal to T1 and greater than 130° C., the process being carried out at pressures of between 1 and 90 bars, wherein of all the mercury and arsenic recovered, most of the mercury is recovered in mass M1, and most of the arsenic is recovered in mass M2, and wherein the recovery mass M2 for arsenic contains at least one element selected from the group consisting of nickel, cobalt, iron, palladium and platinum, and at least one element selected from the group formed by chromium, molybdenum, tungsten and uranium.

8. A process according to claim 7, characterised in that said mass M2 is selected from the group consisting of (a) nickel and molybdenum sulphides, (b) cobalt and molybdenum sulphides, and nickel and (c) tungsten sulphides.

9. A process according to claim 2, wherein recovery mass M1 for the elemental mercury contains at least one compound selected from the group consisting of sulphur, metallic zinc, tin chloride, a copper sulphide, an iron sulphide, silver sulphide, and zinc sulphide.

10. A process according to claim 2, wherein the recovery mass M1 for the elemental mercury contains nickel in the metallic state and that the temperature at which the charge is placed in contact with said mass is between 0° and 130° C.

11. A process according to claim 4, wherein the recovery mass M2 for arsenic contains nickel in metallic state.

12. A process according to claim 10, wherein the recovery mass M2 for arsenic contains nickel in metallic state.

13. A process according to claim 2, wherein the recovery mass M2 for arsenic contains at least one element selected from the group consisting of nickel, cobalt, iron, palladium and platinum, and at least one element selected from the group consisting of chromium, molybdenum, tungsten and uranium.

14. A process according to claim 3, wherein the recovery mass M2 for arsenic contains at least one element selected from the group consisting of nickel, cobalt, iron, palladium and platinum, and at least one element selected from the group consisting of chromium, molybdenum, tungsten and uranium.

15. A process according to claim 4, wherein the recovery mass M2 for arsenic contains at least one element selected from the group consisting of nickel, cobalt, iron, palladium and platinum, and at least one element selected from the group consisting of chromium, molybdenum, tungsten and uranium.

16. A process according to claim 9, wherein the recovery mass M2 for arsenic contains at least one element selected from the group consisting of nickel, cobalt, iron, palladium and platinum, and at least one element selected from the group consisting of chromium, molybdenum, tungsten and uranium.

17. A process according to claim 10, wherein the recovery mass M2 for arsenic contains at least one element selected from the group consisting of nickel, cobalt, iron, palladium and platinum, and at least one element selected from the group consisting of chromium, molybdenum, tungsten and uranium.

18. A process according to claim 2, wherein said mass M2 is selected from the group consisting of (a) nickel and molybdenum sulphides, (b) cobalt and molybdenum sulphides, and (c) nickel and tungsten sulphides.

19. A process according to claim 3, wherein said mass M2 is selected from the group consisting of (a) nickel and molybdenum sulphides, (b) cobalt and molybdenum sulphides, and (c) nickel and tungsten sulphides.

20. A process according to claim 4, wherein said mass M2 is selected from the group consisting of (a) nickel and molybdenum sulphides, (b) cobalt and molybdenum sulphides, and (c) nickel and tungsten sulphides.

21. A process according to claim 1, wherein M1 comprises copper sulfide deposited on an alumina support, and M2 comprises nickel and molybdenum in combination with alumina.

22. A process for the recovery of mercury and arsenic contained in a hydrocarbon charge, the mercury being in elemental form and/or of mercaptides, wherein the charge is placed in contact with at least one recovery mass M1 for mercury in the absence of hydrogen and at a temperature T1 which is less than 175° C., and the product obtained is placed in contact with a recovery mass M2 for arsenic, in the presence of hydrogen, and at a temperature T2 which is greater than or equal to T1 and greater than 130° C., the process being carried out at pressures of between 1 and 90 bars, wherein of all the mercury and arsenic recovered, most of the mercury is recovered in mass M1, and most of the arsenic is recovered in mass M2.

* * * * *